US006201314B1

(12) United States Patent
Landry

(10) Patent No.: US 6,201,314 B1
(45) Date of Patent: Mar. 13, 2001

(54) SHOE SOLE WITH LIQUID-POWERED ELECTRICAL GENERATOR

(76) Inventor: Norman Landry, 541 N. 4$^{th}$ St., Payette, ID (US) 83661

( * ) Notice: Subject to any disclaimer, the term of this patent is extended or adjusted under 35 U.S.C. 154(b) by 0 days.

(21) Appl. No.: 09/348,724

(22) Filed: Jul. 6, 1999

Related U.S. Application Data

(63) Continuation-in-part of application No. 09/069,107, filed on Apr. 28, 1998, now Pat. No. 5,918,381.

(51) Int. Cl.$^{7}$ ..... F03B 13/00
(52) U.S. Cl. ..... 290/54; 310/75 B; 36/3 B
(58) Field of Search ..... 290/54, 1 R; 310/75 B; 36/3 B, 3 R, 2.6

(56) References Cited

U.S. PATENT DOCUMENTS

| | | | | |
|---|---|---|---|---|
| 1,506,282 | * | 8/1924 | Barbieri | 310/75 B |
| 3,273,264 | | 9/1966 | Farinello, Jr. | 36/3 R |
| 4,736,530 | * | 4/1988 | Lakic et al. | 36/2.6 |
| 4,782,602 | | 11/1988 | Lakic | 36/2.6 |
| 4,941,271 | * | 7/1990 | Lakic | 36/2.6 |
| 5,167,082 | | 12/1992 | Chen | 36/2.6 |
| 5,195,254 | * | 3/1993 | Tyng | 36/3 R |
| 5,295,313 | | 3/1994 | Lee | 36/3 R |
| 5,367,788 | * | 11/1994 | Chen | 36/3 B |
| 5,375,345 | | 12/1994 | Djuric | 36/3 R |
| 5,384,977 | | 1/1995 | Chee | 36/28 |
| 5,401,039 | | 3/1995 | Wolf | 280/11.22 |
| 5,495,682 | | 3/1996 | Chen | 36/2.6 |
| 5,860,727 | * | 1/1999 | Chien | 362/84 |

* cited by examiner

*Primary Examiner*—Nestor Ramirez
*Assistant Examiner*—Joseph Waks
(74) *Attorney, Agent, or Firm*—Ken J. Pedersen; Barbara S. Pedersen

(57) ABSTRACT

Various embodiments are described of a liquid-powered dynamometric generator built into a shoe, which has at least two layers as part of its sole. The first or lower layer of the sole is a pad formed of an elastomeric material which contains a liquid within a set of chambers, one in the heel area and one in the toe area of the sole. The ambulatory foot movement inside the shoe puts pressure on the fluid and makes it flow from one chamber area to another. Contained between the chambers is a turbine that is mounted on rotary bearings and positioned within the path of the fluid flow. Due to foot motion, the fluid will flow in an oscillatory fashion while ambulating and thereby cause the turbine to turn. The second or top layer of the sole is a pad that contains one or more dynamometric generators that are coupled by mechanical or magnetic systems to the first layer, such that the action of fluid flow in the first layer imparts rotary motion to the turbine, thereby resulting in the generation of electricity within the second layer. The coupling system(s) may also include gearing or other drive componentry to increase or decrease the speed of the turbine relative to the speed of fluid flow. Electrical energy is therefore generated from the ambulatory motion and can be stored within a rechargeable battery or capacitor, and can be utilized directly for multiple purposes, such as to supply energy to lighting, heating, cooling, computing or communications equipment.

19 Claims, 4 Drawing Sheets

SHOE SOLE WITH LIQUID-POWERED ELECTRICAL GENERATOR

This is a continuation-in-part of my earlier, application Ser. No. 09/069,107, filed Apr. 28, 1998 now U.S. Pat. No. 5,918,381 published in Jul. 6, 1999 and entitled Shoe Sole with Liquid-Powered Ventilating Fans, which is herein incorporated by reference.

BACKGROUND OF THE INVENTION

1. Field of the Invention

The present invention relates generally to a dynamometric product built into the sole of a shoe that generates electrical energy from the action of walking.

Specifically, the invention comprises two layers, one of which has a liquid-filled area with a liquid powered turbine and the other layer containing an electrical generator or generators which are powered by the liquid turbine responding to the liquid movement in the first layer. These two layers are molded or otherwise connected to a shoe sole.

2. Related Art

U.S. Pat. Nos. 5,495,682 and 5,167,082, both by Chen describe and claim another type of dynamometric generator and energy storage means built into the sole of a shoe. This invention utilizes a lever actuator connected to a pivoting platform which moves with the action of raising and lowering the heel of the foot while ambulating. While this device is useful in generating electrical energy, it is dissimilar to the invention described herein, and lacks certain ergonomic and functional benefits that will become apparent from the detailed description which follows.

SUMMARY OF THE INVENTION

Accordingly, the present invention comprises various embodiments of a liquid-powered dynamometric generator built into a shoe which has at least two layers as part of its sole.

The first or lower layer of the sole is a pad formed of an elastomeric molded material which contains a liquid within a molded-in set of chambers, one in the heel area and one in the toe area of the sole. The elastomeric properties of the pad material are such that ambulatory foot movement will put pressure on the fluid and make it flow from one chamber area to another. Contained within an area between the chambers is a turbine that is mounted on rotary bearings and positioned within the path of the fluid flow. Due to foot motion, the fluid will flow in an oscillatory fashion while ambulating, causing the turbine to turn.

The second or top layer of the sole is a pad that contains one or more dynamometric generators which are coupled by mechanical or magnetic means to the first layer, such that the action of fluid flow in the first layer imparts rotary motion to the turbine, thereby resulting in the generation of electricity within the second layer. The coupling means may also include gearing or other drive componentry to increase or decrease the speed of the turbine relative to the speed of fluid flow.

Similarly, the layers may be otherwise configured. The layers could be reversed so that the fluid-compression layer is on top to better use the mechanical motion of the moving foot. Conceivably the two areas of the sole could be arranged side by side. In any configuration, however, the two operative layers are attached to each other and are affixed to the sole of a shoe. One result is maximum foot comfort due to the cushioning and liquid exchange from back to front or front to back of the shoe caused by the pressure changes due to foot movement.

Electrical energy that is generated from ambulatory motion in the manner described above can be stored within a rechargeable battery or capacitor, and can be utilized directly for multiple purposes, such as to supply energy to lighting, heating, cooling, computing or communications equipment.

Other aspects and advantages of the invention will become apparent from the following more detailed description, taken in conjunction with the accompanying drawings.

DESCRIPTION OF THE PREFERRED EMBODIMENTS

Figure 1:
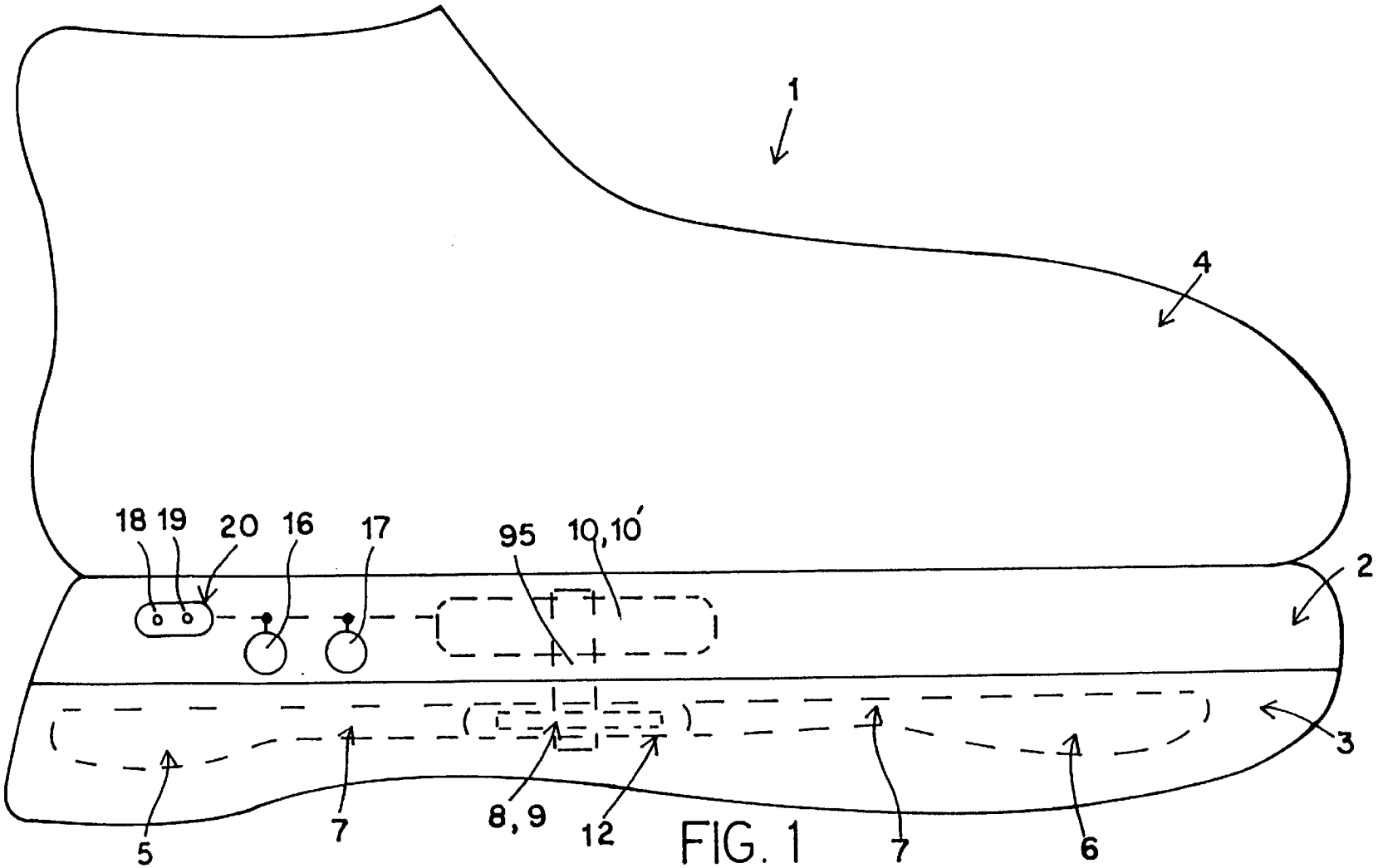
FIG. 1 is a schematic view of the side of a shoe containing one embodiment of the present invention.

Referring to FIG. 1, a schematic view, the side of shoe 1 consists of an upper portion 4, which is attached to sole components 2 and 3. Bottom sole 3 is molded of elastomeric material and contains a heel reservoir 5, toe reservoir 6, and fluid channels 7. Inside the channels 7 is located a sealed turbine assembly 12, which contains turbine wheel 8. The fluid channels 7 are charged with a liquid, non-toxic, anti-freeze type material that can flow between reservoirs 5 and 6. The enclosed turbine 8 is activated by foot pressures upon the encased liquid. The movement of the liquid from reservoir 5 to reservoir 6 and visa-versa causes the turbine to turn. The movement of the turbine wheel 8 is coupled through shaft 9 to the dynamometric generator 10, 10' in top sole 2.

Dynamometric generator 10, 10' can be constructed to generate either AC or DC voltages. Top sole 2 can also contain a capacitor 16 and/or a battery 17. Power can either be used within the shoe for purposes of heating and/or cooling, or power can be provided to the outside of the shoe for other uses through connector 20, which contains pins 18 and 19.

Figure 2:
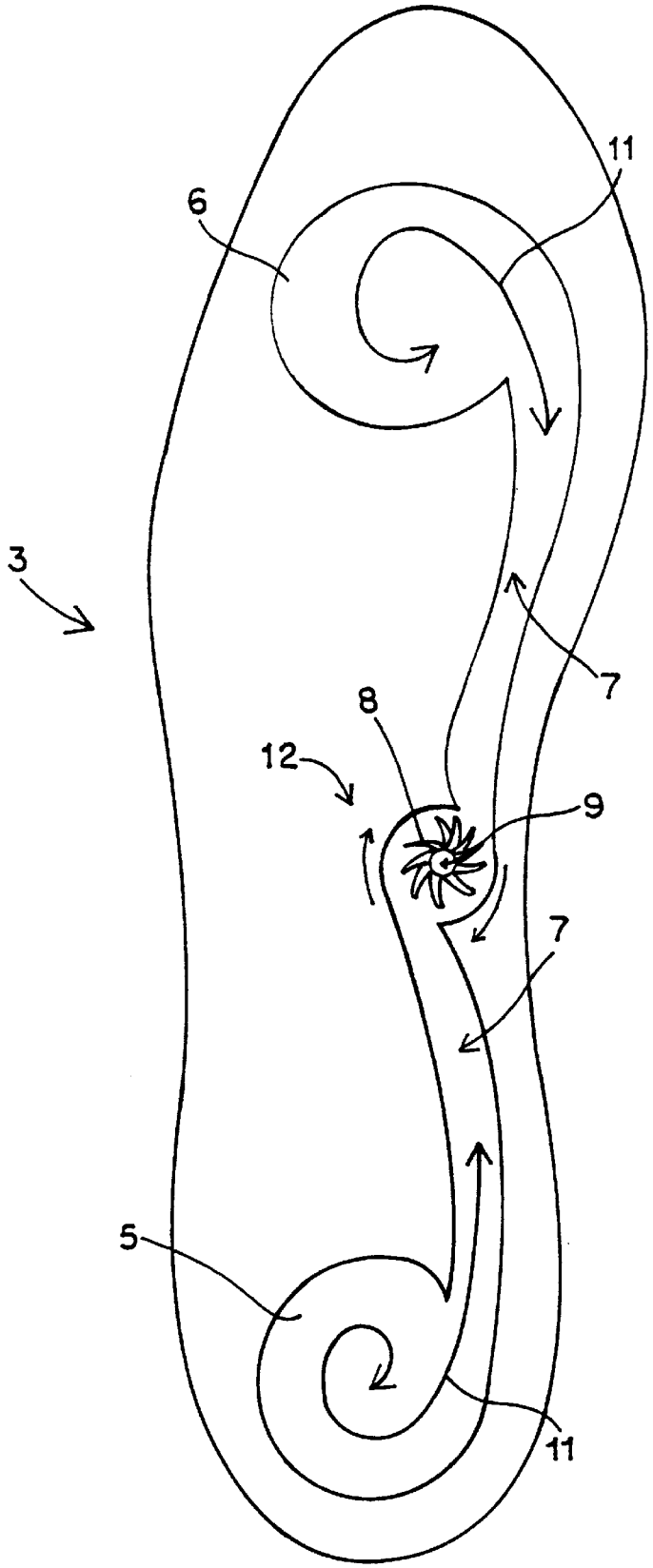
FIG. 2 is a cutaway top view of the fluid layer of one embodiment of the present invention.

Referring to FIG. 2, a top cutaway view of sole layer 3 shows the sealed turbine assembly 12, which contains turbine wheel 8, spinning on shaft 9. This figure also shows the fluid channels 7, as well as reservoirs 5 and 6, which are previously described. Bi-directional flow 11 occurs due to foot pressures upon the encased liquid. This flow 11 imparts uni-directional, clock-wise rotation to turbine 8.

Figure 3:
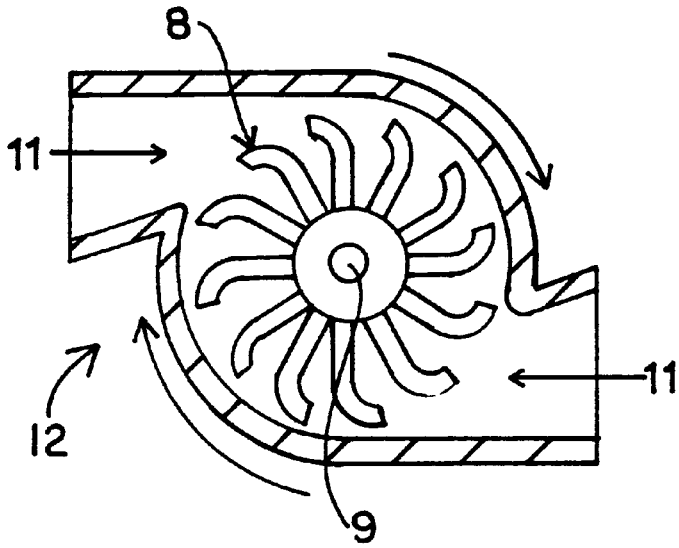
FIG. 3 is a top cutaway view of one embodiment of the fluid layer of the present invention.
Figure 4:
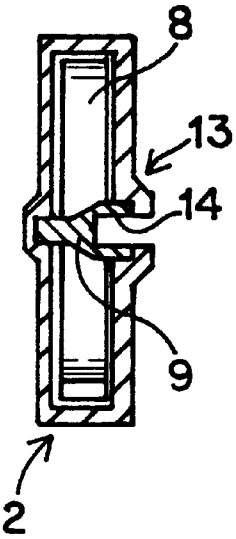
FIG. 4 is a side cutaway view of one embodiment of the fluid turbine component of the present invention.

An embodiment of a liquid powered turbine 12 is shown in FIG. 3, which is a top cutaway view. This view illustrates the liquid turbine housing 12, turbine blades 8, center shaft 9 and fluid flow 11. FIG. 4 shows the same device in a side cutaway view. It preferably comprises a durable, one-piece plastic turbine blade 8 and shaft 9 which is mounted into a split two-piece outer casing 12 with a single seal 13 for preventing liquid leakage. A drive shaft connection socket 14 is also depicted.

Ultimately, the bottom sole layer 3 (FIG. 1) is attached to the upper sole layer 2 (FIG. 1), with shaft 95 from the dynamometric generator 10, 10' inserted into the liquid turbine socket 14, linking the two so that the liquid turbine in FIG. 2 drives the dynamometric generator 10, 10'.

Figure 5:
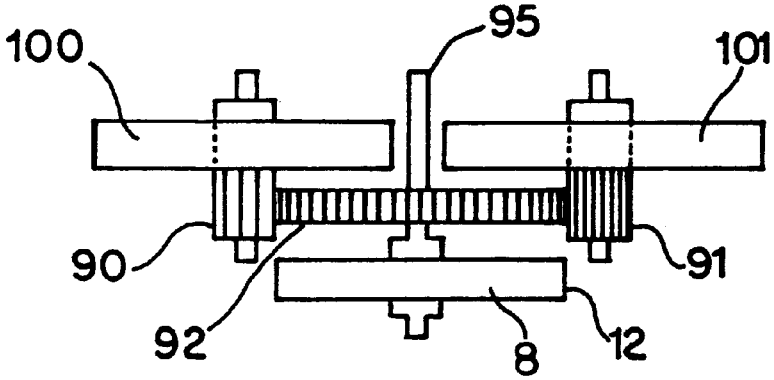
FIG. 5 is a side view of one embodiment of the present invention showing a single fluid turbine coupled to a dual dynamometric generator.

An additional embodiment is depicted in FIG. 5, whereby two dynamometric generators 10, 10' are coupled to the liquid turbine housing 12. This coupling is made via pinion gears 90, 91 and 92. In function, this embodiment is similar to an embodiment using a single dynamometric generator 10.

Figure 6:
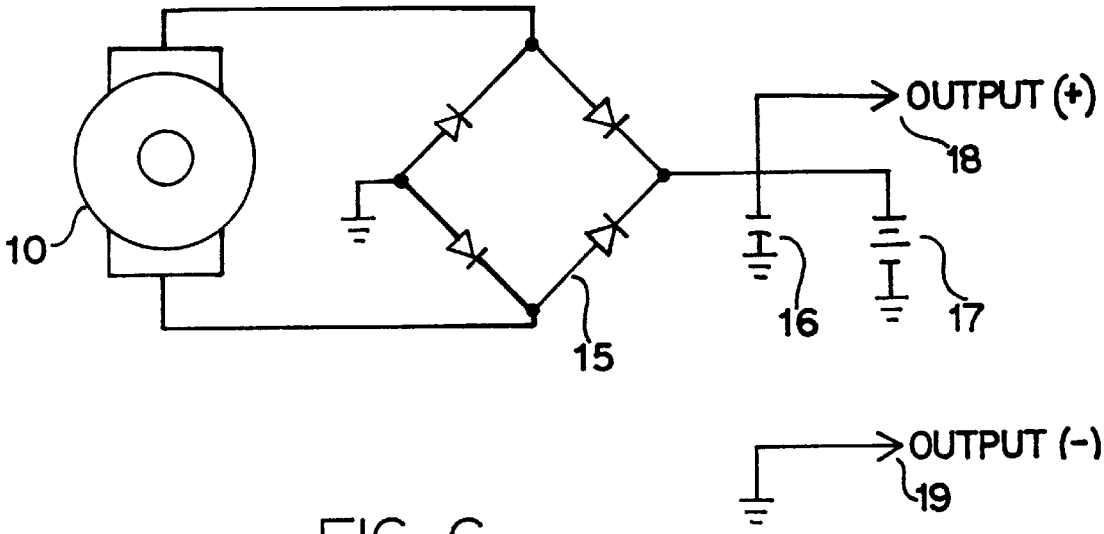
FIG. 6 is an electrical schematic diagram of one embodiment of the present invention using an AC alternator.

FIG. 6 is an electrical schematic diagram of one embodiment of the present invention using an AC alternator 10. Alternator 10 is connected electrically to a rectifier bridge 15, which converts the AC voltage to a DC voltage. The output of rectifier bridge 15 can then be used to charge capacitor 16, and/or battery 17. Power can be provided to the outside of the shoe for external use through pins 18 and 19.

Figure 7:
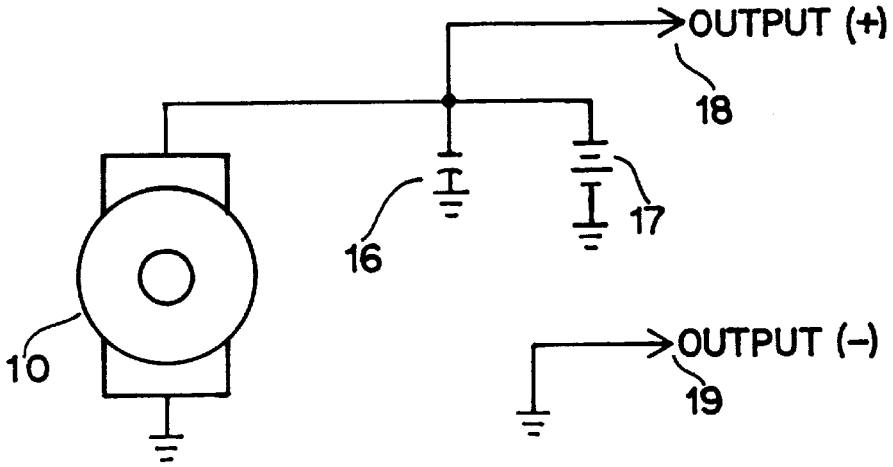
FIG. 7 is an electrical schematic diagram of one embodiment of the present invention using a DC generator.

FIG. 7 is an electrical schematic diagram of another embodiment of the present invention using a DC generator 10'. Generator 10' is connected electrically to capacitor 16, and/or battery 17. Similarly, power can be provided to the outside of the shoe for external use through pins 18 and 19.

Although this invention has been described above with reference to particular means, materials and embodiments, it is to be understood that the invention is not limited to these disclosed particulars, but extends instead to all equivalents within the field of the invention.

I claim:

1. A shoe sole with a liquid-powered electrical generator, comprising:

a set of chambers, one of said chambers being in a heel area and another one of said chambers being in a toe area of the sole;

a fluid contained within said set of chambers, such that an ambulatory foot movement will put pressure on the fluid and make it flow in a path from one of said chambers to the other of said chambers;

a turbine mounted within said path; and a generator coupled to the turbine, such that a rotary motion of the turbine results in generation of electricity by the generator.

2. A fluid-powered electrical power generating system comprising a footwear sole, the sole comprising:

A) interconnecting chambers within compression areas;

B) a fluid contained within the interconnecting chambers, wherein an ambulatory foot movement causes a pressure differential and a fluid flow in a pathway from one of said chambers to another of said chambers;

C) a turbine mounted within said pathway;

D) a drive componentry that adjusts a speed of the turbine relative to a flow velocity of the fluid; and E) a turbine-coupled generator to produce electricity from a rotary motion of the turbine.

3. A power generating system, as in claim 2, comprising a light connected to the generator using a hardwired connection.

4. A power generating system, as in claim 2, comprising a heater connected to the generator using a hardwired connection.

5. A power generating system, as in claim 2, comprising a cooler connected to the generator using a hardwired connection.

6. A power generating system, as in claim 2, comprising a heater and a cooler connected to the generator using a hardwired connection.

7. A power generating system, as in claim 2, comprising a computing equipment connected to the generator using a hardwired connection.

8. A power generating system, as in claim 2, comprising a communication equipment connected to the generator using a hardwired connection.

9. A power generating system, as in claim 2, comprising a battery charger connected to the generator using a hardwired connection.

10. A power generating system, as in claim 2, comprising a light connected to the generator using a detachable connection.

11. A power generating system, as in claim 2, comprising a heater connected to the generator using a detachable connection.

12. A power generating system, as in claim 2, comprising a cooler connected to the generator using a detachable connection.

13. A power generating system, as in claim 2, comprising a heater and a cooler connected to the generator using a detachable connection.

14. A power generating system, as in claim 2, comprising a computing equipment connected to the generator using a detachable connection.

15. A power generating system, as in claim 2, comprising a communication equipment connected to the generator using a detachable connection.

16. A power generating system, as in claim 2, comprising a battery charger connected to the generator using a detachable connection.

17. A power generating system as in claim 2, comprising a gear mechanism that increases and decreases a speed of the turbine relative to a flow velocity of the fluid.

18. A fluid-powered electrical power generating system comprising a footwear sole with a heel and a toe, the sole comprising:

A) a set of chambers comprising a chamber in the heel and a chamber in the toe;

B) a fluid contained within the chambers, wherein an ambulatory foot movement causes a pressure differential and a fluid flow in a pathway from one of said chambers to another of said chambers;

C) a turbine mounted within said pathway;

D) a drive componentry that adjusts a speed of said turbine relative to a flow velocity of said fluid; and E) a turbine-coupled generator to produce electricity from a rotary motion of said turbine.

19. A power generating system as in claim 18, wherein the sole is multi-layered and wherein:

A) the turbine mounts on rotary bearings within said pathway in one layer;

B) the generator exists in a second layer and is mechanically coupled to the first layer.

* * * * *